US007027362B2

(12) United States Patent
Lizzi et al.

(10) Patent No.: US 7,027,362 B2
(45) Date of Patent: Apr. 11, 2006

(54) MULTIFUNCTIONAL ROTATING RING IN A TIMEPIECE

(75) Inventors: Ronald S. Lizzi, Bethany, CT (US); Louis M. Galie, Newtown, CT (US)

(73) Assignee: Timex Group B.V., (NL)

( * ) Notice: Subject to any disclaimer, the term of this patent is extended or adjusted under 35 U.S.C. 154(b) by 0 days.

(21) Appl. No.: 10/733,191

(22) Filed: Dec. 11, 2003

(65) Prior Publication Data

US 2005/0128876 A1 Jun. 16, 2005

(51) Int. Cl.
*G04B 19/20* (2006.01)
*G04F 10/00* (2006.01)

(52) U.S. Cl. ..... 368/37; 368/107; 368/223

(58) Field of Classification Search ..... 368/10, 368/28, 35, 37, 76, 80, 223, 228, 107–110
See application file for complete search history.

(56) References Cited

U.S. PATENT DOCUMENTS 3,982,388 A * 9/1976 Guyot et al. ..... 368/35
4,196,583 A * 4/1980 Komaki ..... 368/73
4,687,341 A * 8/1987 Muller et al. ..... 368/109
4,744,068 A * 5/1988 Nikles et al. ..... 368/190
4,780,864 A * 10/1988 Houlihan ..... 368/10
4,783,773 A * 11/1988 Houlihan et al. ..... 368/108
5,446,702 A * 8/1995 Mossuz et al. ..... 368/37
5,555,226 A * 9/1996 Lizzi ..... 368/21
5,668,781 A * 9/1997 Jeannet et al. ..... 368/28
6,420,959 B1 * 7/2002 Lizzi ..... 340/7.39

* cited by examiner

*Primary Examiner*—Vit W. Miska
(74) *Attorney, Agent, or Firm*—Carmody & Torrance LLP

(57) ABSTRACT

A timepiece having a display for displaying a digit provided on a ring which itself has a plurality of digits provided thereon, wherein the timepiece comprises an integrated circuit operable in at least (i) a date display mode and (ii) a counting mode; a gearing assembly comprising one or more wheels, being meshingly coupled to the ring so that the rotation of the one or more wheels causes the rotation of the ring; a motor, the motor rotateably coupled to the at least one or more wheels of the gearing assembly, wherein the motor has a rotatable member such that the rotation thereof causes the ring to rotate; and mode selecting means for selecting between at least the date display mode and the counting mode; wherein when in the date display mode the ring rotates at a first rate and when in the counting mode the ring rotates at a second rate different from the first rate.

20 Claims, 2 Drawing Sheets

MULTIFUNCTIONAL ROTATING RING IN A TIMEPIECE

BACKGROUND OF THE INVENTION

The present invention relates generally to timepieces, such as wristwatches, and in particular, to improved constructions and methodologies to increase the versatility of such timepieces. The present invention is particularly applicable in timepieces typically referred to as "analog" or "quartz-analog," (i.e. watches having hands for displaying time), and in particular, recognizes a novel use of the date display feature.

Typically, analog watches have one or more rings (e.g. a date ring and/or day ring) for displaying date and/or day information (as the case may be). Recently, there has been an effort to increase the ability and likelihood of maintaining accurate date and/or day information in such analog timepieces. Such timepieces incorporate what may be coined "perpetual calendar" arrangements, where the hands and the calendar ring may be directly (or indirectly) driven by motors, such as stepping motors and/or ultrasonic motors.

The assignee of the present invention is also the owner of the invention described and claimed in copending application Ser. No. 10/716,011 filed Nov. 18, 2003 entitled ("Perpetual Calendar For a Timepiece"). Described and claimed therein are embodiments that incorporate a motor driven date ring. Because the invention described and claimed therein is highly applicable to carrying out the present invention, the disclosure of this application Ser. No. 10/716,011 is incorporated by reference as if fully set forth herein.

Also helpful to an understanding of the present invention is the subject matter of the following commonly owned patents, namely U.S. Pat. Nos. 4,783,773; 4,780,864; 5,555,226, and 6,420,959, the disclosures of which are incorporated by reference as if fully set forth herein.

One of the objectives of the present invention is to make analog watches more functional. For example, it would be advantageous to provide analog watches with a specific timer or lap counting feature, thereby making analog watches more desirable to users.

Accordingly, it is desirable to provide an analog timepiece with improved functionality that overcomes the perceived deficiencies in the prior art noted above and further achieves the aforementioned and below mentioned objectives.

SUMMARY AND OBJECTIVES OF THE INVENTION

Accordingly, it is an objective of the present invention to provide a timepiece with improved functionality.

For example, it is an object of the present invention to provide an improved timepiece comprising at least a date display.

Another object of the present invention to provide an improved timepiece that utilizes the functionality of the date display for conveying additional information to a user, for example, using the date display as a timer or a lap counter.

Still other objects and advantages of the invention will in part be obvious and will in part be apparent from the specification.

The invention accordingly comprises the features of construction, combination of elements, arrangement of parts and sequence of steps which will be exemplified in the construction, illustration and description hereinafter set forth, and the scope of the invention will be indicated in the claims.

Generally speaking, in accordance with the present invention, an improved timepiece having a display for displaying a digit provided on a ring which itself has a plurality of digits provided thereon, is provided. In this first embodiment, the timepiece comprises an integrated circuit operable in at least (i) a date display mode and (ii) a counting mode, wherein the timepiece further comprises a gearing assembly comprising one or more wheels, being meshingly coupled to the ring so that the rotation of the one or more wheels causes the rotation of the ring; a motor, the motor rotateably coupled to the at least one or more wheels of the gearing assembly, wherein the motor has a rotatable member such that the rotation thereof causes the ring to rotate; and mode selecting means for selecting between at least the date display mode and the counting mode; wherein when in the date display mode the ring rotates at a first rate and when in the counting mode the ring rotates at a second rate different from the first rate.

In specific features of this first embodiment, the counting mode is preferably user selectable; the mode selecting means comprises an externally actuatable switch; in the date display mode the ring rotates in a first direction being clockwise or counterclockwise, and wherein in the counting mode the ring rotates in the other direction; when placed in the counting mode, the ring is rotatable to a selectable starting position such that the displayed digit changes from the digit representing the then current date of the month to a starting digit representing a start time for a count and when placed back in the date display mode, the ring rotates to once again display the digit representing the then current date of the month; the integrated circuit maintains correct date information so that when the timepiece returns to the date display mode the digit representing the then current date is displayed; the first rate is at least essentially (360/31)° of rotation essentially every 24 hours; and the second rate is at least essentially (360/31)° of rotation essentially every minute. In a particular feature, repeated and/or continuous actuation of the switch causes the displaying of successive digits on the ring. Although not required, the motor is preferably a bidirectional stepping motor.

In accordance with another embodiment of the present invention, the motor causes the rotation of the ring in both the date display mode and the counting mode; and when in the counting mode, the ring rotates in response to actuation of an externally actuated switching means. As will be disclosed below, many of the features of the first embodiment are applicable and thus incorporated by reference into this second embodiment.

BRIEF DESCRIPTION OF THE DRAWINGS

For a fuller understanding of the invention, reference is had to the following description taken in connection with the accompanying figures, in which.

Also, while not all elements are labeled in each figure, all elements with the same reference number indicated similar or identical parts.

DETAILED DESCRIPTION OF THE PREFERRED EMBODIMENTS

For purposes of the present invention, it is presumed that the reader has a familiarity with the invention described and claimed in copending U.S. application Ser. No. 10/716,011, but for the convenience of the reader, the following is set forth.

Figure 1:
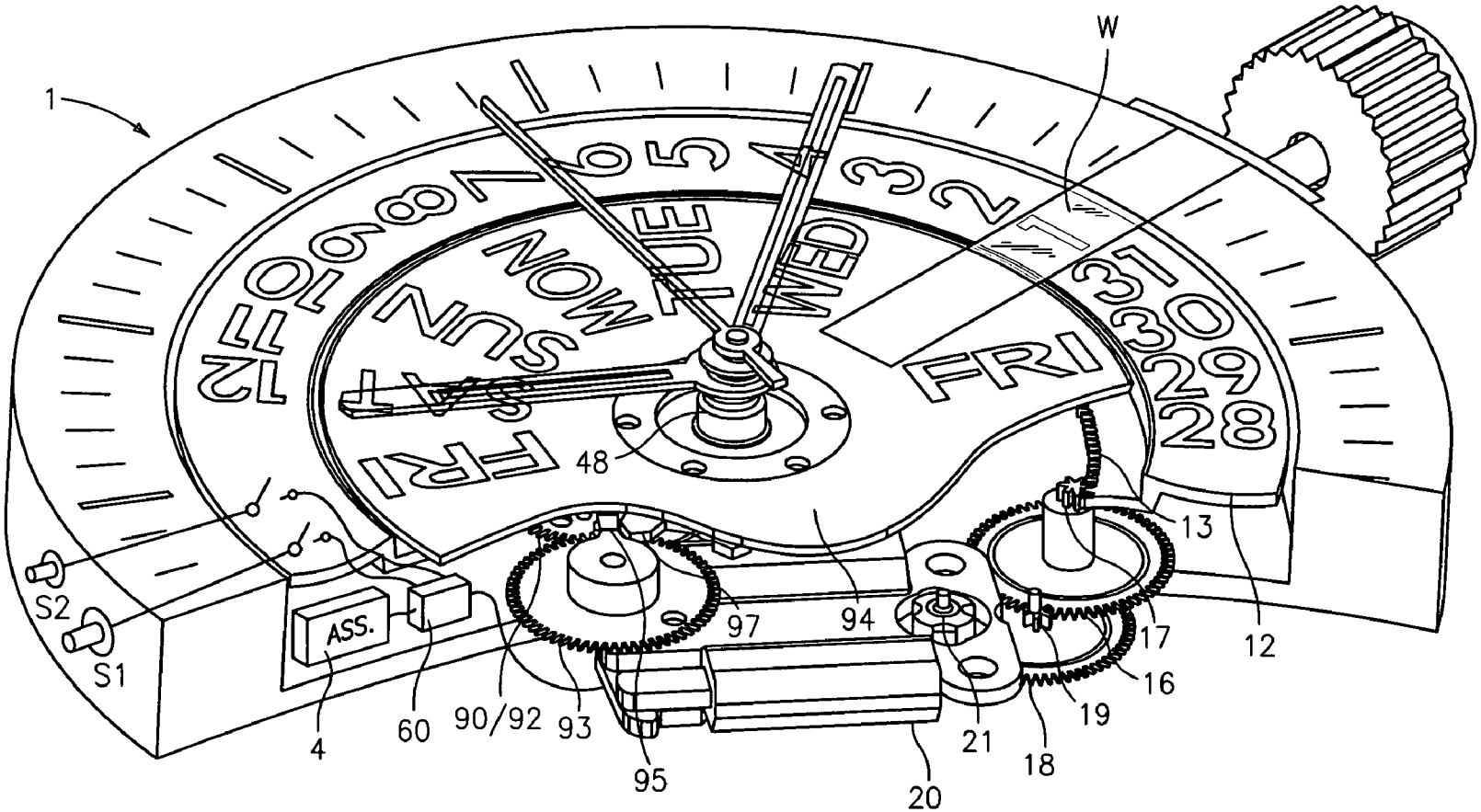
FIG. 1 is a perspective view (in partial cutaway) of a timepiece constructed in accordance with the present invention.

Reference is first generally made to FIG. 1 wherein a timepiece, generally indicated at 1 and including features of the present invention, is disclosed. FIG. 1 illustrates, among other things, a preferred construction of a date display assembly constructed in accordance with the present invention. Specifically, the date display assembly comprises a date ring 12, on which a plurality of digits (e.g. "1", "2", "3," . . . "31") may be printed, silkscreen, painted, or otherwise provided. Date ring 12 preferably has a plurality of teeth 13 on the inner circumference thereof for meshing with a gearing assembly which will now be disclosed.

In the preferred embodiment, the gearing assembly for the date display assembly comprises one or more wheels. Illustrated in FIG. 1 is a date wheel 16 on which is a pinion 17. Date wheel 16 is coupled to date ring 12 via teeth on pinion 17 being in meshing alignment with teeth 13 of date ring 12. The gearing assembly also includes an intermediate date wheel 18, which itself also includes a pinion 19 that is in meshing alignment with the outer teeth of date wheel 16. In this way, the rotation of the one or more wheels (e.g. date wheel 16 and intermediate date wheel 18) causes the rotation of date ring 12, as will be further explained below. Of course, it should be understood that the number of wheels included in the gearing assembly may be more or less than that disclosed herein, and are really one of design choice for the intended function and based upon a number of known criterions, such as power and torque constraints.

Lastly, the date display assembly of the preferred embodiment preferably also comprises a stepping motor, generally indicated at 20. Stepping motor 20 will comprise a rotor 21, which in the preferred embodiment, is rotatably coupled to the at least one or more wheels of the first gearing assembly (e.g. intermediate date wheel 18). That is, rotor 21 will preferably comprise teeth that meshingly aligns with the outer teeth on intermediate date wheel 18. The selection of a suitable stepping motor and the arrangement and/or positioning of the components are all within the purview of one skilled in the art. Moreover, although the preferred construction utilizes a stepping motor, other types of motors, such as an ultrasonic motor could be used to adequately carry out the present invention. Accordingly, reference to motor, unless specified, should be broadly construed to include any motor that can satisfactorily carry out the present invention.

Figure 2:
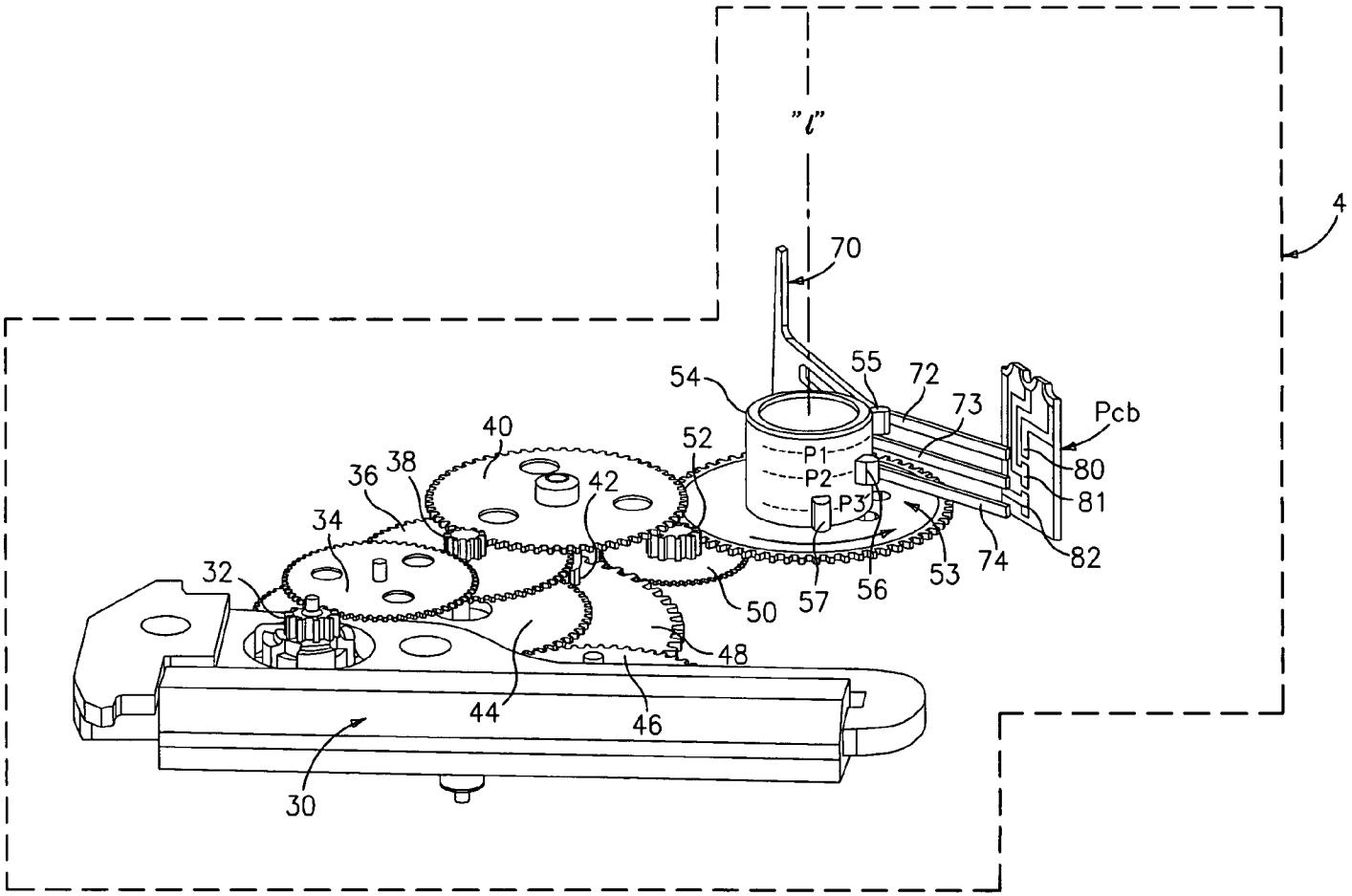
FIG. 2 is a perspective view of a date-keeping assembly in accordance with the present invention.

Although described now in generalities, omitted herein for brevity is a detailed explanation of a date-keeping assembly (generally indicated by reference numeral 4), constructed in accordance with the present invention, as the particulars of this aspect of the construction of the timepiece are not material to the present invention, although sufficiently disclosed in the aforementioned application Ser. No. 10/716,011, and illustrated in FIG. 2 for the convenience of the reader.

Date-keeping assembly of the present invention comprises at least a second gearing assembly comprising in particular, at least an hour wheel 48 and a detection wheel assembly, generally indicated at 53, which is operatively coupled by rotation to hour wheel 48. An understanding of the relationships and intercouplings of the wheels illustrated in FIG. 2. Suffice it to say that the rotation of hour wheel 48 will cause, via intermediate wheel 50, the rotation of detection wheel assembly 53. The direction of rotation of detection wheel assembly 53 (i.e. clockwise or counterclockwise) can also be controlled by the direction of rotation (i.e. clockwise or counterclockwise) of hour wheel 48. For example, it should be clearly understood that stepping motor 30 is the motor to drive the hands (See FIG. 1) of the timepiece. Stepping motor 30 includes a rotor 32 that is meshingly engaged with intermediate wheel 34. Intermediate wheel 34 includes a pinion 35 that is meshingly engaged with a second wheel 36. Second wheel 36 includes a pinion 38 that is meshingly engaged with a third wheel 40. A pinion 42 of third wheel 40 is meshingly engaged with a center wheel 44. The outer circumference of center wheel 44 is in meshing alignment with minute wheel 46. A pinion 47 of minute wheel 46 is meshingly aligned and engaged with hour wheel 48. Completing the date keeping assembly, hour wheel 48 in turn is in meshing alignment with an intermediate wheel 50. Intermediate wheel 50 has a pinion 52 which is in meshing alignment with the outer circumference of the toothed wheel portion which makes up a part of detection wheel assembly 53. As also would be clearly understood by one skilled in the art, coupled to second wheel 36 is the second hand, coupled to center wheel 44 is the minute hand and coupled to hour wheel 48 is the hour hand.

Timepiece 1 maintains information regarding the clockwise or counterclockwise direction (and amount of rotation) of detection wheel assembly 53, and can thus accurately cause the rotor of stepping motor 20 to rotate in one of a forward or reverse direction (as the case may be) so that date ring 12 can be rotated in the proper clockwise or counterclockwise direction. To assist in providing this functionality, an integrated circuit 60 is provided. Integrated circuit 60 may comprise some or all of the functionality of the controller described in copending and coowned application Ser. No. 10/441,417, and therefore, the relevant subject matter of this application Ser. No. 10/441,417 is incorporated by reference as if fully set forth herein. Generally speaking, integrated circuit 60 will receive signals upon at least certain rotational increments of detection wheel assembly 53, process such signals and based thereon, cause the rotor of stepping motor 20 to rotate in the proper clockwise or counterclockwise direction so that date ring 12 can, as the case may be, rotate clockwise or counterclockwise. In this way, the rotation of hour wheel 48 through a predetermined "midnight" position results in date ring 12 rotating a predetermined number of degrees, thereby advancing either in the forward or backward direction a displayed digit on date ring 12. Moreover, as desirable in the present invention, integrated circuit 60 also maintains the position of the date ring 12, and thus, knowledge of what digit is being displayed, as integrated circuit 60 will know the position of date ring 12 by knowing the position of the rotor of stepping motor 20. Accordingly, accurate date information can be maintained when the hands (e.g. hour wheel 48) have been stopped, whether intentionally or inadvertently.

As seen in FIG. 1, timepiece 1 is provided with a display, such as display window "W" through which the digits on ring 12 are viewable. Now, in accordance with the present invention, integrated circuit 60 can operate in at least (i) a date display mode and (ii) a counting mode. In the date display mode, timepiece will display the current date and will cause the rotation of ring 12 should detection wheel 53 rotate (or should a 24 hour period elapse) as disclosed above. In the counting mode however, ring 12 will presumably rotate at a much faster rate.

More specifically, in date display mode, and with the hands stopped, ring 12 shall rotate one position (i.e. so a next digit is displayed) every 24 hours. For a more detailed description of the positioning of the setting stem to stop the rotation of hour wheel 48, reference can also be had to coowned and copending application Ser. Nos. 10/331,827 and 10/349,339, the subject matter of which are also incorporated by reference as if fully set forth herein. Such signaling is under the control of integrated circuit 60, which controls the signaling to motor 20. However, in the counting mode, integrated circuit may cause the ring to rotate one position every 60 seconds, or at another desired rate because the present invention provides a motor to directly control the rotation of ring 12. In this way, ring 12 becomes much more functional since programming can permit the customization of the rotation of thereof.

Provided by the present invention is also a mode selector for selecting between at least the date display mode and the counting mode. That is, integrated circuit 60 may be electrically coupled to components, such as one or more switches S1, S2, as also illustrated in FIG. 3 of the aforementioned application Ser. No. 10/441,417. Such is provided, by way of example, by pushers generically indicated by S1, S2. Depressing pusher S1 in a designated sequence (even just one depression is sufficient) can place integrated circuit 60 in the counting mode, especially if pusher S1 is a dedicated mode selector. The use of pushers to move about a plurality of modes is the subject of one or more of the patents set forth above, and clearly within the scope of the skilled artisan.

A significant distinction of the present invention from the prior art is that in the date display mode ring 12 rotates at a first rate, and in the counting mode ring 12 rotates at a second rate different from the first rate. By way of example, when the ring is in the date display mode, ring 12 will rotate (as shown in FIG. 1) in the clockwise direction and its rate of rotation can be indicated by (360/31)° of rotation essentially every 24 hours.

On the other hand, in the counting mode, ring 12 can effectively be a timer, such as a 30-minute timer (or any other value, although a timer of intervals (such as minutes) between 1 and 31 is the easiest examples to readily appreciate). Thus, in the counting mode and under the control of integrated circuit 60, the rate of rotation is much faster. Since the intervals between rotations are a matter of design choice, for purposes of illustration (and not limitation), increments of 60 seconds are used. It can be seen that in the counting mode, ring 12 may thus be caused to rotate one digit essentially every 60 seconds. In other words, the second rate is at essentially (360/31)° of rotation essentially every minute. Moreover, if ring 12 is used as a countdown timer, it can be clearly seen that the direction of rotation of ring 12 in the counting mode is opposite to the direction of rotation of ring 12 in its normal date display mode.

Further, to distinguish other prior art devices that merely are able to rotate a date ring at more than one rate (e.g. at the juncture of February $28^{th}$ or $29^{th}$ to March $1^{st}$), an important feature of the present invention is that the counting mode is user selectable. That is, entering the counting mode is achieved by the user, and not automatically achieved by the integrated circuit itself. As illustrated for exemplary purposes and not limitation, the mode selector comprises an externally actuatable switch S1. Such mode selector can also be in the form of the crown itself or a rotatable ring, thus incorporating by reference the disclosure set forth in U.S. Pat. No. 5,742,565.

In accordance with another feature of the present invention, when placed in the counting mode, ring 12 is rotatable to a selectable starting position such that the displayed digit changes from a digit representing the then current date of the month to a starting digit representing a start time for a count; and when placed back in the date display mode, ring 12 rotates to once again display the digit representing the then current date of the month. That is, integrated circuit 60, by virtue of memory therein or associated therewith, can keep accurate information regarding the number of steps that stepping motor 20 makes during any time interval.

For example, if in the normal (e.g. date display) mode the displayed digit was 1 (see FIG. 1), and the user desired to enter the counting mode and countdown from 20 minutes (for example), the user could simply actuate (i.e. depress) switch S1 or the like, thus entering the counting mode. Repeated actuations of switch S1 (or continuous actuation thereof) would cause integrated circuit 60 to step stepping motor 20 such that ring 12 rotates until the digit "20" is displayed. After a predetermined delay to indicate that the displayed digit is the correct one (e.g. after no further actuations of S1), another subsequent actuation of switch S1 will cause ring 12 to rotate at the second rate (in the disclosed example, rotating one digit every 60 seconds). Alternatively, another switch, such as switch S2, could be used to start the timer (e.g. with switch S1 being used to set the timer to the desired starting position). All of these alternatives are clearly within the purview of one ordinarily skilled in the art.

It should be understood that with the date ring illustrated in FIG. 1, a user would be anticipating the display of the number "31" for the elapsing of 20 minutes (in the above example). However, in a slight alternative to this first embodiment, the date ring would be provided with a zero ("0") digit, thereby having 32 digits indicated on the date ring. In many respects, this alternative embodiment would operate similarly, except that the rotational speed thereof would be calculated using the denominator 32 instead of 31 in the formula noted above. Moreover, since the controller maintains "knowledge" of the position of the date ring, adding another digit would not complicate the construction of the invention. Furthermore, having a "0" digit may provide additional user friendliness (i.e. intuitiveness) to the invention.

Still further, having a "0" digit on the date ring provides yet an additional advantage, namely, if the user sets the timer to a nonzero digit, the controller may "assume" that the timer is intended to be in a countdown mode. If the "0" digit is selected, clearly the intention is to be in a count up mode. Without the "0" on the date ring, the selectability of the count up or countdown mode is preferably user selectable.

Although not explicitly illustrated, timepiece 1 may have a dedicated mode selector, such as switch S1, with one or more setting pushers S2. In this way, a different and possibly more user intuitive interface can be provided. Again, it would be well within the purview of one skilled in the art to design an interface for entering the counting mode, selectively rotating the ring to a desired starting position, and then commencing the timer operation.

Once integrated circuit 60 has counted the 20 minutes (and the ring is now presumably displaying "31", the user could once again (i) restart the timer (again by a push button sequence well within the skill of one in the art) at which point ring 12 would again rotate to its starting value of "20", (ii) select a new starting position (e.g. "25" minute countdown) in the manner set forth above, or (iii) the user could reenter the "normal" date display mode by either depressing the mode selector pusher S1 or by another actuation sequence. And as indicated above, since integrated circuit 60 maintains correct date information, when timepiece 1 returns to the date display mode, the digit representing the then current date is redisplayed by causing ring 12 to rotate until the digit "1" (in this particular example) is redisplayed. To be clear, although the use of pushers is explicitly disclosed, the selector or selector means is deemed to include an axially displaceable and rotatable setting stem and/or a rotatable ring, as disclosed herein.

As can therefore be seen above, the present invention provides a novel appreciation of the date ring in a timepiece. In particular, by directly controlling the rotatability of the date ring, it can be used as a countdown or countup timer, with the intervals being user selectable and/or programmable. Moreover, because of the use of an integrated circuit as disclosed herein, the timepiece can easily maintain accurate date information, so that at the conclusion of the use of the timepiece in the counting mode (i.e. returning to the date display mode), the accurate date can once again be displayed.

In accordance with another feature of the present invention, timepiece 1 is again provided with mode selecting means for selecting between at least the date display mode and the counting mode, and again the mode selector or mode selecting means can be an manually actuatable pusher such as switch S1, an axially displaceable setting stem and/or a rotatable top ring. While the motor (preferably a stepping motor) causes the rotation of the ring in both the date display mode and the counting mode, the distinguishing feature in this embodiment is that in the counting mode, the ring rotates in response to actuation of an externally actuated switching means.

That is, in a counting mode of the present embodiment, ring 12 can be used as a traditional counter. The uses of such a feature are applicable to everything from a lap counter to the score on a golf hole, just to name a few.

More specifically, in this embodiment, each actuation of the switching means will cause ring 12 to rotate one position such that a next successive (or prior) digit is displayed through window W.

Again, when in the date display mode, a displayed digit is representable of the then current date of the month (such as that displayed in FIG. 1 by the digit "1"). However, when placed in the counting mode, the ring is rotatable to a selectable starting position such that the displayed digit changes from the digit representing the then current date of the month to a starting digit representing the start of a count; and when placed back in the date display mode, the ring rotates to once again display the digit representing the then current date of the month. For example, if the ring is to be used as a count-up counter, and the user desires to enter the counting mode, the user could simply actuate (i.e. depress) switch S1 or the like, thus entering the counting mode. Repeated actuations of switch S1 (or continuous actuation thereof, if appropriate or applicable) would cause integrated circuit 60 to step stepping motor 20 such that ring 12 rotates one digit upon each actuation. Similarly, timepiece 1 may have a dedicated mode selector, such as switch S1, with a setting pusher S2 so that while S1 is used to enter the counting mode, the setting pusher (again, which could be the setting stem or a rotating crown, just to name a few) would be used to specifically rotate ring 12 in the appropriate increments. Again, it would be well within the purview of one skilled in the art to design an interface for entering the counting mode and selectively rotating the ring. Depression of the mode selector such as switch S1 would cause ring 12 to rotate to redisplay the correct date digit.

Clearly, in either of the foregoing embodiments, if the starting or ending displayed digit for the timer or the starting or ending displayed digit for the counter is actually the digit for the correct date, then no particular rotation of ring 12 for that step is needed, as would be understood. Such would be the case for the example of FIG. 1 wherein the correct date is deemed to be the first of the month, yet in a counting mode, it would not be unreasonable that the number "1" be the starting digit for the lap counting feature of the present invention. Either way, because integrated circuit 60 maintains correct date information, when the timepiece returns to the date display mode the digit representing the then current date is redisplayed.

In all other respects, the features of the first embodiment are applicable to this second embodiment, and therefore should be seen to be incorporated by reference therein. Such features, as appropriate, are thus incorporated into the claims as presented. Moreover, it is conceivable that the sequences used for the present embodiments would be the same for certain situations. For example, in the first embodiment (i.e. the countup/down timer), the depression of one of the pushers would clearly have the ring rotating as if it was in the lap counting mode. Thus, there is some overlap in the two embodiments, with some of the distinctions being in the user interface and pusher sequences to carry out each of the steps (i.e. entering the counting mode, initializing the ring to the desired digit, beginning the count and returning the ring to the date position and/or restarting or resetting the ring starting point. Again, all of such features should be understood by one skilled in the art after consideration of the present disclosure.

It can thus be seen that the present invention provides numerous advantages not found in the prior art. For example, the present invention provides an improved timepiece comprising a date and/or day display that utilizes motors, and stepping motors in particular. More specifically, the present invention furthers the state of the art by incorporating a countdown and/or countup timer feature, as well as a counter feature into a timepiece that includes a date and/or day ring controlled by a dedicated motor.

While the invention has been particularly shown and described with respect to preferred embodiments thereof, it will be understood by those skilled in the art that changes in form and details may be made therein without departing from the scope and spirit of the invention.

What is claimed is:

1. A timepiece having a display for displaying a digit provided on a ring which itself has a plurality of digits provided thereon, wherein the timepiece comprises an integrated circuit operable in at least (i) a date display mode and (ii) a counting mode, wherein the timepiece further comprises:

a gearing assembly comprising one or more wheels, being meshingly coupled to the ring so that the rotation of the one or more wheels causes the rotation of the ring;

a motor, the motor rotatably coupled to the at least one or more wheels of the gearing assembly, wherein the motor has a rotatable member such that the rotation thereof causes the ring to rotate; and mode selecting means for selecting between at least the date display mode and the counting mode;

wherein when in the date display mode the ring rotates at a first rate and when in the counting mode the ring rotates at a second rate different from the first rate; and wherein at least substantially the same digits are used for both the date display mode and the counting mode.

2. The timepiece as claimed in claim 1, wherein at least the counting mode is user selectable.

3. The timepiece as claimed in claim 2, wherein the mode selecting means comprises an externally actuatable switch.

4. The timepiece as claimed in claim 1, wherein in the date display mode the ring rotates in a first direction being clockwise or counterclockwise, and wherein in the counting mode the ring rotates in the other direction.

5. The timepiece as claimed in claim 1, wherein in the date display mode, a displayed digit is representable of the then current date of the month; and wherein:

when placed in the counting mode, the ring is rotatable to a selectable starting position such that the displayed digit changes from the digit representing the then current date of the month to a starting digit representing a start time for a count; and when placed back in the date display mode, the ring rotates to once again display the digit representing the then current date of the month.

6. The timepiece as claimed in claim 5, wherein the integrated circuit maintains correct date information so that when the timepiece returns to the date display mode the digit representing the then current date is displayed.

7. The timepiece as claimed in claim 1, wherein the ring rotates in one of a clockwise and counterclockwise direction at the first rate, wherein the first rate is at least essentially (360/31)° of rotation essentially every 24 hours.

8. The timepiece as claimed in claim 1, wherein the ring rotates in one of a clockwise and counterclockwise direction at the second rate, wherein the second rate is at least essentially (360/31)° of rotation essentially every minute.

9. The timepiece as claimed in claim 5, wherein the mode selecting means comprises a switch and wherein actuation of the switch causes the ring to rotate.

10. The timepiece as claimed in claim 9, wherein repeated and/or continuous actuation of the switch causes the displaying of successive digits on the ring.

11. The timepiece as claimed in claim 1 wherein the motor is a stepping motor, and the stepping motor comprises a rotor rotatably coupled to the at least one or more wheels of the gearing assembly, wherein the rotation of the rotor causes the ring to rotate.

12. A timepiece having a display for displaying a digit provided on a ring which itself has a plurality of digits provided thereon, wherein the timepiece comprises an integrated circuit operable in at least (i) a date display mode and (ii) a counting mode, wherein the timepiece further comprises:

a gearing assembly comprising one or more wheels, being meshingly coupled to the ring so that the rotation of the one or more wheels causes the rotation of the ring;

a motor, the motor rotatably coupled to the at least one or more wheels of the gearing assembly, wherein the motor has a rotatable member such that the rotation thereof causes the ring to rotate; and mode selecting means for selecting between at least the date display mode and the counting mode;

wherein:

the motor causes the rotation of the ring in both the date display mode and the counting mode; and when in the counting mode, the ring rotates in response to actuation of an externally actuated switching means; and wherein at least substantially the same digits are used for both the date display mode and the counting mode.

13. The timepiece as claimed in claim 12, wherein in the date display mode, a displayed digit is representable of the then current date of the month; and wherein:

when placed in the counting mode, the ring is rotatable to a selectable starting position such that the displayed digit changes from the digit representing the then current date of the month to a starting digit representing the start of a count; and when placed back in the date display mode, the ring rotates to once again display the digit representing the then current date of the month.

14. The timepiece as claimed in claim 13, wherein the integrated circuit maintains correct date information so that when the timepiece returns to the date display mode the digit representing the then current date is displayed.

15. The timepiece as claimed in claim 12, wherein:

in the date display mode the ring rotates at a rate at least essentially (360/31)° of rotation every 24 hours; and in the counting mode the ring is rotatable at a rate significantly faster than the first rate.

16. The timepiece as claimed in claim 15, wherein the rate at which the ring is rotatable in the counting mode is at least essentially (360/31)° per actuation of the switching means.

17. The timepiece as claimed in claim 12, wherein repeated and/or continuous actuation of the switching means causes the displaying of successive digits on the ring.

18. The timepiece as claimed in claim 12, wherein the motor is a stepping motor, and the stepping motor comprises a rotor rotatably coupled to the at least one or more wheels of the gearing assembly, wherein the rotation of the rotor causes the ring to rotate.

19. A timepiece having a display for displaying a digit provided on a ring which itself has a plurality of digits provided thereon, wherein the timepiece comprises an integrated circuit operable in at least (i) a date display mode and (ii) a timer mode, wherein the timepiece further comprises:

a gearing assembly comprising one or mare wheels, being meshingly coupled to the ring so that the rotation of the one or more wheels causes the rotation of the ring;

a motor, the motor rotatably coupled to the at least one or more wheels of the gearing assembly, wherein the motor has a rotatable member such that the rotation thereof causes the ring to rotate; and mode selecting means for selecting between at least the date display mode and the timer mode;

wherein when in the date display mode the ring rotates at a first rate which is at least essential (360/31)° of rotation essentially every 24 hours and when in the timer mode the ring rotates at a second rate which is at least essentially (360/31)° of rotation every period of time, wherein the period of time is less than 24 hours.

20. The timepiece as claimed in claim 19, wherein:

the ring rotates in one of a clockwise and counterclockwise direction at the first rate, wherein the first rate is at least essentially (360/31)° of rotation essentially every 24 hours; and the ring rotates in one of a clockwise and counterclockwise direction at the second rate, wherein the second rate is at least essentially (360/31)° of rotation essentially every minute.

* * * * *

UNITED STATES PATENT AND TRADEMARK OFFICE

CERTIFICATE OF CORRECTION

PATENT NO. : 7,027,362 B2
APPLICATION NO. : 10/733191
DATED : April 11, 2006
INVENTOR(S) : Ronald S. Lizzi et al.

It is certified that error appears in the above-identified patent and that said Letters Patent is hereby corrected as shown below:

Column 10, Line 41, delete “mare” and replace it with --more--

Column 10, Line 51, delete “essential” and replace it with “essentially”

Signed and Sealed this

First Day of August, 2006

JON W. DUDAS
*Director of the United States Patent and Trademark Office*